US005543909A

United States Patent [19]

Quesnel

[11] Patent Number: 5,543,909

[45] Date of Patent: Aug. 6, 1996

[54] TWO STEP, LARGE LATITUDE, STALLED ROLL REGISTRATION SYSTEM

[75] Inventor: Lisbeth S. Quesnel, Pittsford, N.Y.

[73] Assignee: Xerox Corporation, Stamford, Conn.

[21] Appl. No.: 415,798

[22] Filed: Apr. 3, 1995

[51] Int. Cl.[6] ..... G03G 15/00

[52] U.S. Cl. ..... 355/317; 271/228; 271/242

[58] Field of Search ..... 355/317; 271/227, 271/228, 242; 395/111; 347/139, 153

[56] References Cited

U.S. PATENT DOCUMENTS

| | | | |
|---|---|---|---|
| 3,963,339 | 6/1976 | Taylor et al. | 355/317 |
| 4,025,187 | 5/1977 | Taylor et al. | 355/317 |
| 4,128,327 | 12/1978 | Sugiyama et al. | 355/309 |
| 4,135,804 | 1/1979 | Schoppe et al. | 355/315 |
| 4,685,664 | 8/1987 | Petersdorf | 271/227 |
| 4,887,101 | 12/1989 | Hirose et al. | 347/153 X |
| 5,157,449 | 10/1992 | Matsuno et al. | 355/317 |
| 5,278,624 | 1/1994 | Kamprath et al. | 355/317 |
| 5,362,041 | 11/1994 | Ryuzaki et al. | 271/242 X |

FOREIGN PATENT DOCUMENTS 63-257769 10/1988 Japan .

*Primary Examiner*—Joan H. Pendegrass
*Assistant Examiner*—Sophia S. Chen
*Attorney, Agent, or Firm*—William A. Henry, II

[57] ABSTRACT

A stalled roll registration method and apparatus used as the sole timing adjustment in a paper path includes a clutch or motor driven registration nip, a buckle chamber and two sensors. After a sheet reaches a sensor upstream of the registration nip, the sheet lead edge advances a fixed distance into the stalled registration nip in order to buckle a known amount. Afterwards, the registration nip advances the deskewed sheet until a second sensor downstream of the registration nip is reached. The registration nip then stops, allowing the sheet to form an upstream buckle. This second buckle can be large since the lead edge is constrained by the registration nip. Therefore, large timing variations between sheet locations and image locations can be accommodated.

8 Claims, 2 Drawing Sheets

TWO STEP, LARGE LATITUDE, STALLED ROLL REGISTRATION SYSTEM

BACKGROUND OF THE INVENTION

This invention relates to a registration apparatus for a copier or printer. Registration is provided when a sheet which is being fed along a desired path is intercepted by a stop member to properly position it along the path in a timed relationship with an image means for applying the image to it.

In the past, this type of mechanism consisted of intermittently rotating rollers whose speed equaled the process speed of the photosensitive member surface, or a cam type mechanism, which fed the copy substrate or transfer material on a signal from the copying process to synchronize it with the movement of the print-forming section of the photosensitive member. For this type of mechanism it is difficult to minimize the error in matching the positions of the leading edge of the copy sheet to the print forming section of the photoreceptor below the allowable tolerance of about 2 mm. This is because it is impossible to perfectly synchronize the movement of the print forming section of the photosensitive member with the intermittent drive of the rollers due to the time difference between receipt of the signal and the rollers intermittent driving of the transfer material, the faster the rollers rotate the greater the error in adjusting the position of the leading edge of the transfer material to the print forming section becomes as a result. Also, copy substrates are sometimes captured by registration rolls in a skewed state with the substrates being transported to an image transfer station with the copy substrate remaining in the skewed state.

PRIOR ART STATEMENT

Many different sheet registration devices are known in the sheet feeding art, for example, U.S. Pat. No. 3,963,339 to Taylor et al. discloses an apparatus wherein sheets fed from a supply in a reproducing machine are forwarded against a movable stop and buckled. A chute forming member movable with the stop provides space for buckling when the stop is blocking sheet movement and aids in flattening the buckle when the stop is not blocking sheet movement. In U.S. Pat. No. 4,025,187, to Taylor et al. discloses a sensor arrangement that senses the position of an edge of a fed sheet adjacent a front stop at a registration nip. Timing circuitry responsive to the sensor arrangement is used to time a reference time interval from the sensing edge. The timing circuitry is coupled to a sheet feeder and is capable of stopping the sheet feeder upon the expiration of the reference time interval. The reference time interval is selected to be sufficiently long to allow the sheet feeder when feeding a sheet to form a buckle in the sheet. Wayne F. Shoppe et al. in U.S. Pat. No. 4,135,804 show a sheet registration apparatus that includes a resilient means which cooperates with a stop member to control the path of a sheet as it is intercepted by the stop member. In U.S. Pat. No. 4,128,327 to Mitsuhiko Sugiyama et al. a method and apparatus is disclosed for synchronizing copy sheet positioning with an image position on a photoreceptor in an electronic copier that includes primary rollers which drive intermittently at a slower speed than the process speed of the copier while feeding a copy sheet to the photoreceptor. Secondary rollers which are located between the primary rollers and the photoreceptor drive the copy sheet continuously at the process speed. After the copy sheet enters the secondary rollers, the primary rollers stop driving and allow the copy sheet to continue in travel by the driving force of the secondary rollers in synchronism with the image of the photoreceptor.

Dissatisfaction with large lead edge timing variations of previous registration systems have lead to the use of multiple retiming stations along the paper path, for example, in the duplex loop, vertical transports and feeders, to adjust the arrival time of sheets to registration. However, this type of registration subsystem can absorb some of the timing variation, but not all of the variations and it is costly.

SUMMARY OF THE INVENTION

Accordingly, the present invention provides a stalled roll registration subsystem that uses a registration roll to absorb all timing variations with the registration subsystem acting as the sole timing adjustment in the paper path. The lead edge timing latitude of the stalled roll registration subsystem is increased by engaging a clutch after a sheet has buckled a small amount into a stalled registration roll. The stalled registration roll is then rotated and moves the sheet forward until it reaches a downstream sensor. The registration roll is stalled again. The sheet continues to be driven by drive rolls and is buckled into the registration roll a predetermined amount. The clutch is then engaged to move the sheet into position for transfer of an image thereto from a photosensitive member. This two step method and apparatus increases the lead edge timing window to an extent heretofore impossible.

BRIEF DESCRIPTION OF THE DRAWINGS

The foregoing and other features of the instant invention will be apparent from a further reading of the specification, claims and from the drawings in which:

All references cited in this specification, and their references, are incorporated by reference herein where appropriate for teachings of additional or alternative details, features, and/or technical background.

While the present invention will be described hereinafter in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

The invention will now be described by reference to a preferred embodiment of the registration system of the present invention preferably for use in a conventional copier/printer. However, it should be understood that the stalled roll registration method and apparatus of the present invention could be used in any machine environment in which synchronization of sheets with a downstream working station is desired.

In general, an improvement to prior sheet sheet registration systems is disclosed which is cost effective, requires less space and parts than previous registration systems and comprises the use of a stalled roll registration system with the capability of deskewing sheets and correcting for large lead edge timing variations.

Figure 3:
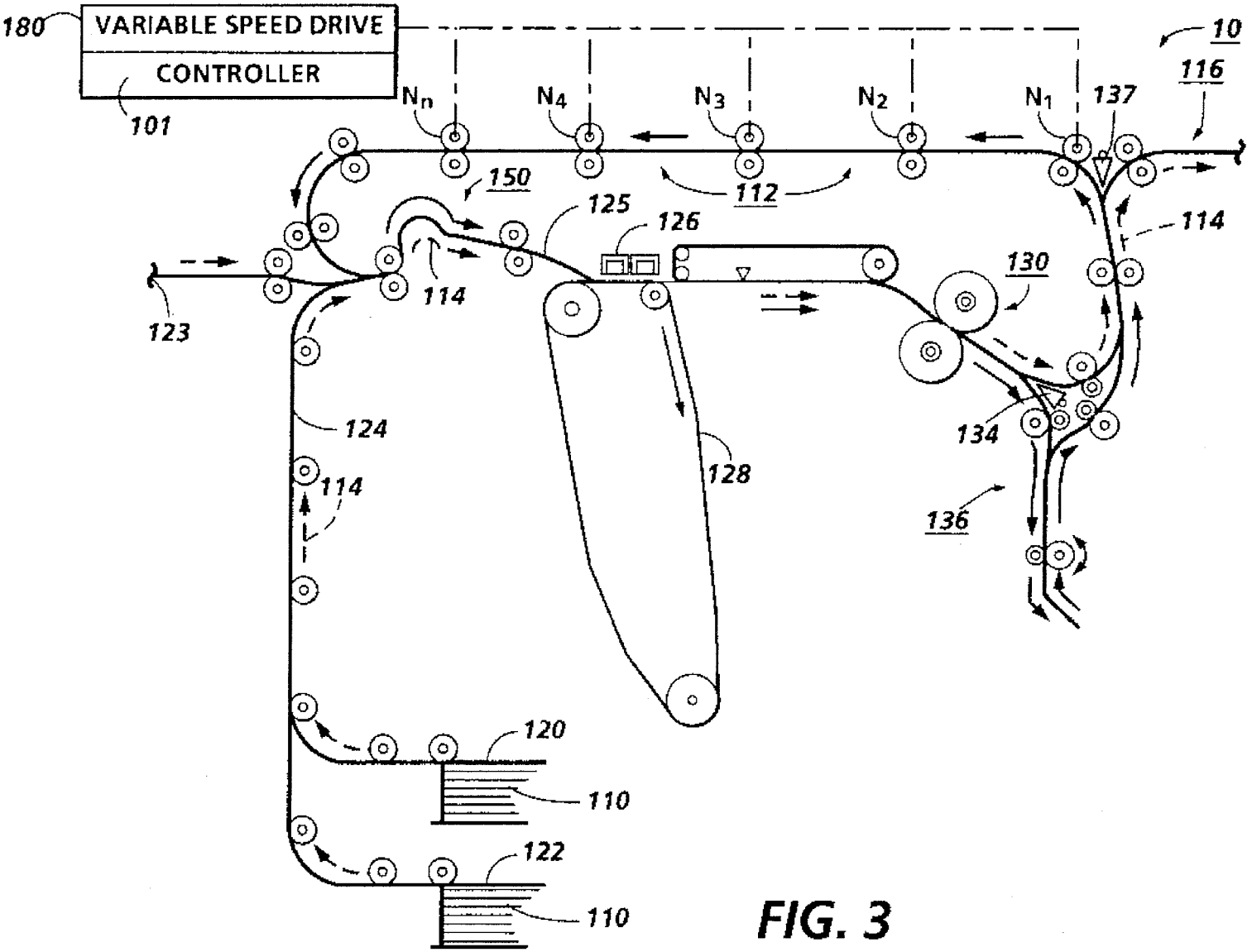
FIG. 3 is an elevational view illustrating schematically an exemplary duplex printer incorporating the stalled roll registration of FIG. 1 therein.

For a general understanding of the features of the present invention, reference is made to the drawings. In the drawings like reference numerals have been used throughout to designate identical elements. FIG. 3 schematically depicts the various components of an illustrative electrophotographic printing machine incorporating the stalled roll registration apparatus of the present invention therein. It will become evident from the following discussion that the registration apparatus is equally well suited for use in a wide variety of printing machines and is not necessarily limited in its application to the particular embodiment shown herein.

Describing first in further detail the exemplary printer embodiment with reference to FIG. 3, there is shown a duplex laser printer 10, by way of example, of automatic electrostatographic reproducing machines of a type suitable to utilize the registration system of the present invention. Although the disclosed method and apparatus is particularly well adapted for use in such digital printers, it will be evident from the following description that it is not limited in application to any particular printer embodiment. While the machine 10 exemplified here is a xerographic laser printer, a wide variety of other printing systems with other types of reproducing machines may utilize the disclosed registration system.

Turning now more specifically to this FIG. 3 system 10, the photoreceptor is 128, the clean sheets 110 are in paper trays 120 and 122 (with an optional high capacity input path 123), the vertical sheet input transport is 124, transfer is at 126, fusing at 130, inverting at 136 selected by gate 134, etc. There is an overhead duplex loop path 112 with plural variable speed feeders $N_1$-$N_n$ providing the majority of the duplex path 112 length and providing the duplex path sheet feeding nips; all driven by a variable speed drive 180 controlled by the controller 101. This is a top transfer (face down) system. An additional gate 137 selects between output 116 and dedicated duplex return loop 112 here.

In this FIG. 3 embodiment, the endless loop duplex (second side) paper path 112 through which a sheet travels during duplex imaging is illustrated by the arrowed solid lines, whereas the simplex path 114 through which a sheet to be simplexed is imaged is illustrated by the arrowed broken lines. Note, however, that the output path 116 and certain other parts of the duplex path 112 are shared by both duplex sheets and simplex sheets. These paths are also shown with dashed-line arrows, as are the common input or "clean" sheet paths from the paper trays 120 or 122

After a "clean" sheet is supplied from one of the regular paper feed trays 120 or 122 in FIG. 3, the sheet is conveyed by vertical transport 124 and stalled roll registration transport 150 past image transfer station 126 to receive an image from photoreceptor 128. The sheet then passes through fuser 130 where the image is permanently fixed or fused to the sheet. After passing through the fuser, a gate 134 either allows the sheet to move directly via output 116 to a finisher or stacker, or deflects the sheet into the duplex path 112, specifically, first into single sheet inverter 136 here. That is, if the sheet is either a simplex sheet, or a completed duplex sheet having both side one and side two images formed thereon, the sheet will be conveyed via gate 134 directly to output 116. However, if the sheet is being duplexed and is then only printed with a side one image, the gate 134 will be positioned by a conventional sensor (led emitter and receiver not shown) and controller 101 to deflect that sheet into the inverter 136 of the duplex loop path 112, where that sheet will be inverted and then fed to sheet transports 124 and 125 for recirculation back through transfer station 126 and fuser 130 for receiving and permanently fixing the side two image to the backside of that duplex sheet, before it exits via exit path 116.

Figure 1:
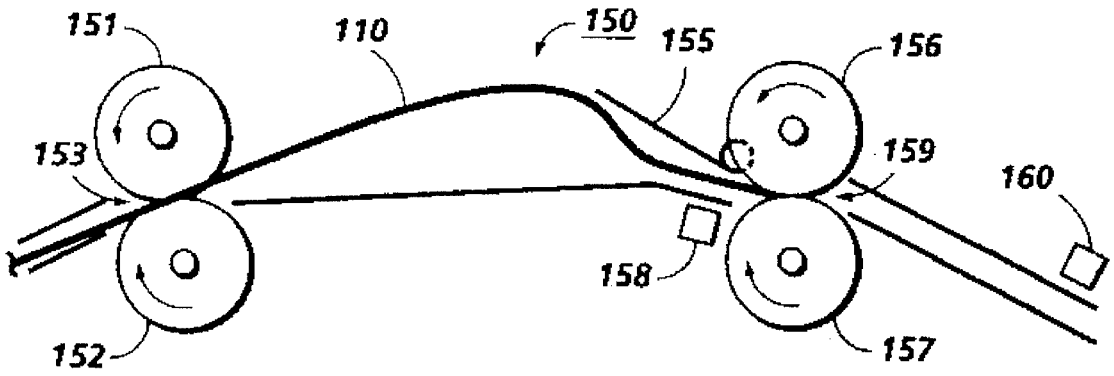
FIG. 1 is an elevational view showing the stalled roll registration apparatus of the present invention with a sheet buckling into a stalled registration nip after being sensed by a sensor.
Figure 2:
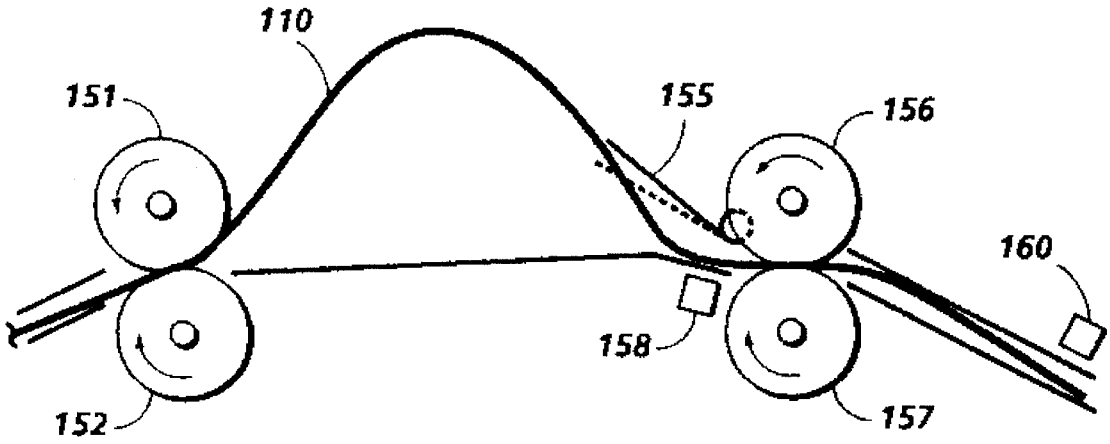
FIG. 2 is an elevational view showing the stalled rolled registration apparatus of FIG. 1 with the sheet being advanced to a second sensor while continuing to be buckled.

Referring now to the subject matter of the present invention, FIG. 1 depicts an embodiment 150 of the stalled roll registration apparatus of the present invention in detail. The registration apparatus 150 is under the control of controller 101 and features a shaft mounted idler roll 151 that forms a sheet driving preregistration nip 153 with drive roll 152. Shaft mounted idler roll 156 forms a registration nip 159 with registration roll 157. A conventional clutch (not shown) controlled by controller 101 is mounted on the same shaft as registration roll 157. Sensor 158 is positioned immediately upstream of registration roll 157 and a second sensor 160 is positioned a predetermined distance downstream of registration roll 157. Stalled roll registration system 150 is the sole timing adjustment in the paper path and is operated by driving a sheet 110 with driving nip 153 past sensor 158 which detects the lead edge of the incoming sheet. The sheet is allowed to buckle into stalled registration roll 157 of registration nip 159 for approximately 10 mm, or an optimum number, to deskew the sheet. Then the registration clutch is engaged to drive the stalled registration roll 157 to advance the sheet, as shown in FIG. 2, until the lead edge reaches a second sensor 160 downstream of the registration roll. At this point, the clutch is disengaged thereby stalling registration roll 157 again and the sheet stops. Preregistration nip 153, which is driven continuously, drives the sheet into the now stalled registration nip 159. The sheet 110 then continues to buckle against movable buckle chamber member 155 attaining a much larger buckle than is normally possible. After a predetermined time, stalled roll 157 is again engaged by the clutch in accordance-with a signal from controller 101 in order to drive the sheet to transfer station 126. This two step sheet registration method significantly increases the lead edge timing window which allows for a wide range of sheet sizes to be accommodated, particularly benefiting the shortest length sheets. An advantage of using this two step method is the cost savings obtained by eliminating multiple retiming stations in the paper path.

It is, therefore, evident that there has been provided in accordance with the present invention a low cost registration method and apparatus for copiers/printers or the like which serves to deskews and correct large lead edge timing variations, thereby fully satisfying the aims and advantages hereinbefore set forth. The apparatus consists of a clutch or motor driven drive nip, a buckle chamber, and two sensors. After reaching the first (upstream) sensor, the sheet lead edge is advanced a fixed distance into a stalled registration nip, thereby buckling a predetermined amount. At this point, the nip advances the deskewed sheet until the second (downstream) sensor is reached. The nip is then stopped, allowing the sheet to form an upstream buckle. This second buckle can be large since the lead edge is constrained by the nip. Therefore, large timing variations can be accommodated at low cost. If desired, the second sensor can be eliminated.

Some of the advantages of stalled roll registration system of the present invention over the prior stalled roll registration systems include the increased latitude that is effective for all sheet lengths, from 5 to 18 inches long; the reduced amount of buckle that must be contained in the buckle chamber, thereby reducing the size and height requirements of the buckle chamber; the elimination of timing stations and their attendant costs; the reduction of cumulative paper path errors due to the placement of the second sensor close to transfer; the low additional cost of simply adding one sensor downstream of the registration nip; the ease of incorporation of the method and apparatus into current machine configurations; the system can be incorporated in a machine configuration whether a clutch and motor or a stepper motor is used in the registration nip; and simplifies other paper paths and timing requirements.

While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. In a copier/printer having a photosensitive member rotatable at a set velocity and capable of receiving page image information thereon and copy substrate feeders for feeding copy substrates toward the photosensitive member to have the page image information transferred thereto, a transfer station for transferring the page information from the photosensitive member to the copy substrates and a paper path leading from the copy substrate feeders to the transfer station, the improvement in a two step stalled roll registration system comprising:

a first nip for driving copy sheets within said paper path, said first nip including an idler roll and a continuously driven drive roll which continuously drives copy sheets;

a second nip positioned downstream of said first nip and a predetermined distance upstream of said transfer station, said second nip including a drive roll and an idler roll with said drive roll being adapted for intermittent driving;

a first sensor immediately adjacent to and upstream of said second nip;

a second sensor positioned a predetermined distance downstream of said second nip; and a controller adapted to stall said second nip for a first predetermined time upon receipt of a signal from said first sensor indicating the presence of the lead edge of a copy substrate in order to allow the copy substrate to form a first buckle into said stalled second nip for deskew and registration purposes, actuate said second nip until the lead edge of the copy substrate is detected by said second sensor whereupon said second nip is stalled again for a second predetermined time period to form a second buckle in the copy substrate during said second predetermined time period with said second nip being restarted a second time by said controller after said second predetermined time period expires in order to synchronize the copy sheet substrate with page image information on said photosensitive member.

2. The improvement of claim 1, including a clutch connected to said drive roll of said second nip, said clutch being adapted to engage and disengage said drive roll of said second nip in response to signals from said controller.

3. The improvement of claim 1, including a stepper motor connected to said drive roll of said second nip, said stepper motor being adapted to drive said drive roll of said second nip in response to signals from said controller.

4. A printing machine adapted to produce copies on sheets fed through a plurality of processing stations in the machine including an imaging station, a transfer station, sheet feeders and a paper path leading from the copy sheet feeders to the transfer station, the machine having a stalled roll sheet registration system for deskewing, registering and timing the lead edge of sheets with images presented at the transfer station from the imaging station, said stall roll registration apparatus comprising:

a preregistration nip for continuously forwarding sheets in a predetermined direction in said paper path;

a periodically driven registration nip positioned downstream of said preregistration nip and closely adjacent said transfer station for registering and deskewing sheets and forwarding them to said transfer station to receive images thereon;

a first sensor immediately upstream of said registration nip adapted to sense the lead edge of incoming copy sheets;

a second sensor downstream of said registration nip adapted to sense the lead edge of each copy sheet leaving said registration nip; and a controller for receiving said signals from said first and second sensors and controlling said periodic driving of said registration nip based upon said first and second signals.

5. The printing machine of claim 4, wherein said preregistration nip is continuously driven.

6. The printing machine of claim 5, wherein said registration nip is stalled by said controller for a predetermined of time to allow a copy sheet to buckle into said registration nip as the sheet is driven by said preregistration nip in response to a signal from said first sensor and then restarted to drive the copy sheet toward said transfer station.

7. The printing machine of claim 6, wherein said registration nip is stalled a second time by said controller for a predetermined of time once a signal is received from said second sensor indicating the presence of the lead edge of a copy sheet in order to allow the copy sheet to again to buckle into said registration nip as the sheet is driven by said drive nip, and wherein said registration nip is restarted a second time in synchronous timing with an image en route to said transfer station.

8. A method of synchronizing the position of a copy substrate with an image on a photosensitive member, comprising the steps of:

(a) providing a photosensitive member rotating at a given velocity with a transferable image thereon;

(b) providing a continuously driven preregistration nip and feeding a copy substrate toward said photosensitive member with said preregistration nip;

(c) providing a registration nip downstream of said preregistration nip to receive copy substrates driven thereinto by said preregistration nip;

(d) positioning a first sensor upstream of said registration nip to sense the lead edge of copy substrates driven by said preregistration nip;

(e) positioning a second sensor downstream of said registration nip and upstream of said photosensitive member to sense the lead edge of substrates being driven by said registration nip; and (f) providing a controller adapted to control the driving and stopping of said registration nip based on signals from said first and second sensors.

* * * * *